US006797064B2

(12) United States Patent
Sashihara

(10) Patent No.: US 6,797,064 B2
(45) Date of Patent: Sep. 28, 2004

(54) PAINTING EQUIPMENT AND PAINTING METHOD

(75) Inventor: Kouichi Sashihara, Kumamoto (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/731,023

(22) Filed: Dec. 10, 2003

(65) Prior Publication Data

US 2004/0112284 A1 Jun. 17, 2004

Related U.S. Application Data

(62) Division of application No. 09/939,837, filed on Aug. 28, 2001, now Pat. No. 6,713,132.

(30) Foreign Application Priority Data

Aug. 31, 2000 (JP) ..... 2000-262477

(51) Int. Cl.[7] ..... B05C 13/02

(52) U.S. Cl. ..... 118/320; 118/326; 118/66; 118/58

(58) Field of Search ..... 118/319, 320, 118/326, 66, 58; 427/425, 379, 422, 424; 198/463.1, 469.1, 478.1

(56) References Cited

U.S. PATENT DOCUMENTS 4,607,588 A * 8/1986 Stants et al. ..... 118/52
4,776,085 A * 10/1988 Shiiba ..... 29/824
5,115,758 A 5/1992 Suzuki et al.
5,322,156 A * 6/1994 Kakita et al. ..... 198/463.3
5,551,552 A * 9/1996 Ophardt et al. ..... 198/465.1
5,769,949 A * 6/1998 Cienkus et al. ..... 118/621
5,996,771 A * 12/1999 Estes ..... 198/686

FOREIGN PATENT DOCUMENTS

JP 61-229718 * 10/1986
JP 44844 2/1992
JP 6-134360 A 5/1994
JP 7-275755 * 10/1995

* cited by examiner

*Primary Examiner*—Laura Edwards
(74) *Attorney, Agent, or Firm*—Birch, Stewart, Kolasch & Birch, LLP

(57) ABSTRACT

A shuttle feed passage 7 is provided in each functional processing station from a coating booth 1 to an after-heating booth 6 for performing a series of operations from coating to baking and drying. A conveyance frame 12 is fed to each of the booths 1–6 using a shuttle feed method, and conveyance of the workpiece W is stopped to perform the coating operation and the like. An empty conveyance frame 12 from which the coated workpiece W is removed is circulated through a self-propelled feed passage 9. A carriage 39 of the conveyance frame 12 is caused to travel outside the booth 1, and the supporting arm 13 of the conveyance frame 12 is caused to travel inside the booth, wherein the supporting arm is caused to rotate around the axis.

7 Claims, 8 Drawing Sheets

PAINTING EQUIPMENT AND PAINTING METHOD

This application is a divisional of Ser. No. 09/939,837, filed Aug. 28, 2001, now U.S. Pat. No. 6,713,132.

BACKGROUND OF THE INVENTION

1. Field of the Invention

The present invention relates to equipment and a method for painting a fuel tank and the like for use in a motorcycle.

2. Description of the Prior Art

Equipment for painting a fuel tank for use in a motorcycle is known in the prior art. For example, in Japanese Utility Model Publication No. Hei 4-4844, painting is performed by rotating a support member for supporting a workpiece around its axis to prevent paint applied to a painting surface from dripping and forming a non-uniform paint film. Further, as shown in FIG. 9, in a method for providing a conveyance device 52 for a workpiece W within a spray-booth 51, there is the possibility that paint to be sprayed onto the workpiece W will adhere to a conveyer or the like of the conveyance device 52 and some paint peeling off from the conveyer may adhere to the workpiece W, thereby causing inferior painting. To avoid such a problem, in Japanese Unexamined Patent Publication No. Hei 6-134360, only a supporting rod for supporting the workpiece is inserted into the spray booth and a means for moving the supporting rod is arranged outside the spray booth.

However, according to the conventional painting methods, since the workpiece is always moved during painting, it is difficult to raise the painting quality and the like to more than a fixed level. Further, to improve the painting quality beyond a certain extent, there is a problem that equipment construction becomes complicated and large.

SUMMARY OF THE INVENTION

It is therefore an object of the present invention to provide painting equipment of which the construction is compact and which can improve the painting quality and the like.

To attain the above-mentioned object, according to the present invention, painting equipment in which a workpiece is fed to functional processing stations in order, by a conveyance device to perform a series of operations from coating to baking and drying is provided, characterized in that the conveyance device comprises a shuttle feed mechanism for conveying a conveyance frame for supporting the workpiece using a shuttle feeding method from upstream functional processing stations toward downstream functional processing stations, and a self-propelled mechanism for allowing the conveyance frame to cyclically travel from the downstream functional processing stations to the upstream functional processing stations by itself.

In this manner, if the workpiece is conveyed to the functional processing stations, in order, using the shuttle feeding method and once conveyance is completed, movement of the work is stopped to perform painting, baking, drying, etc., it is possible to perform high quality painting and the like.

The functional processing stations include a painting station for performing the painting, a setting station for removing solvents etc., a preheating station for preheating, a UV baking station for baking the paint, an after-heating station for drying a paint film, and the like.

After a series of operations is completed, the workpiece is removed from the conveyance frame. The conveyance frame is then fed into the self-propelled mechanism to allow the conveyance frame to travel by itself and return to the upstream functional processing station for circulation. Thus, it is possible to make the entire equipment construction compact.

To allow the conveyance frame to travel by itself, a slope can be provided, for example, on a floor to make the construction inexpensive.

The conveyance frame is composed of a carriage which travels outside a booth for each functional processing station and a workpiece supporting arm which is supported by the carriage and extends to the inside of the booth, wherein the workpiece supporting arm is rotatably provided around an arm axis by a rotational mechanism.

In this manner, if the carriage for supporting the workpiece supporting arm is provided outside the booth, it is possible to prevent paints from adhering to a conveyance driving section and prevent some paint peeling off from the conveyance driving section from adhering to the workpiece, thereby causing inferior painting.

Further, by spraying the paint on the workpiece and rotating the workpiece supporting arm, it is possible to prevent the paint from dripping to provide a uniform painting film and to improve the painting quality further.

A self-propelled feed passage used as a return passage is provided with a downward slope toward a workpiece supply section side to allow the conveyance frame to return to the workpiece supply section side from its own weight.

A rotational positioning mechanism is provided on the downstream side of the functional processing stations to control a rotational position of the workpiece supporting arm at a fixed location.

By having the direction of the workpiece supporting arm fixed by this rotation positioning mechanism, it is possible to make the removal of the workpiece from or the setting of the next workpiece into the workpiece supporting arm easier.

The mechanism for rotating the workpiece supporting arm around the arm axis is composed of a chain provided along the shuttle feed passage, and a sprocket which engages a section of the chain travelling in the opposite direction from the travelling direction of the conveyance frame and transmits a driving force to the axis of the workpiece supporting arm. Accordingly, it is possible to rotate the workpiece supporting arm with certainty and by a simple mechanism.

The above and other objects, features and advantages of the present invention will become more apparent from the following description when taken in conjunction with the accompanying drawings.

DETAILED DESCRIPTION OF THE PREFERRED EMBODIMENTS

Painting equipment according to the present invention is constructed as the equipment for painting, for example, a fuel tank for use in a motorcycle, in which painting quality can be improved and the equipment construction can also be compacted. After a conveyance frame is fed toward functional processing stations using a shuttle feeding method, conveyance of the workpiece is stopped for processing in each function. When a series of processing is completed, the workpiece is removed from the conveyance frame to allow the conveyance frame to travel by itself for circulation.

Figure 1:
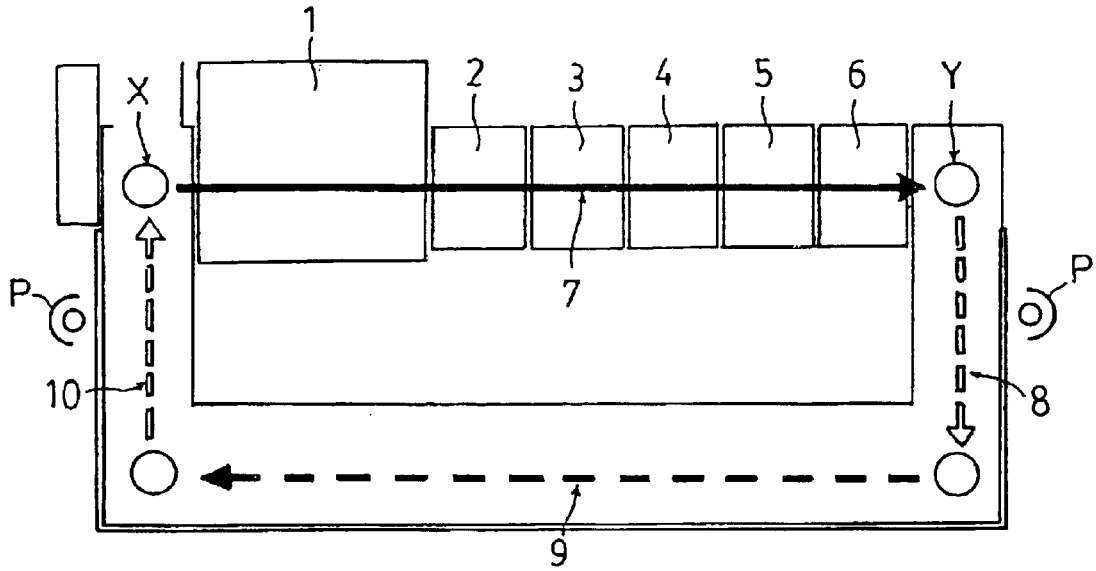
FIG. 1 is a plan view showing a construction outline of the present painting equipment.

Namely, an outline of the present equipment construction is shown in FIG. 1, in which the functional processing stations include a spray booth 1, a setting booth 2, a preheating booth 3, a UV baking booth 4, and after-heating booths 5, 6 which are provided in series. Provided on the upstream side of the spray booth 1 is a supply section X, and a removal section Y is provided on the downstream side of the after-heating booth 6. A shuttle feed passage 7 passing each functional processing station is provided between the supply section X and the removal section Y to shuttle-feed a conveyance frame 12 described later. The conveyance frame 12 for supporting the workpiece W is conveyed in order along this shuttle feed passage 7 from the supply section X on the upstream side toward the removal section Y on the downstream side using the shuttle feed motion. After the processed workpiece W is removed from the conveyance frame 12 at the removal section Y, the conveyance frame 12 is conveyed through a manual feed passage 8 to a self-propelled feed passage 9 to allow it to travel toward the upstream side by itself. The conveyance frame 12 is then conveyed through a manual feed passage 10 to the supply section X for circulation.

Figure 2:
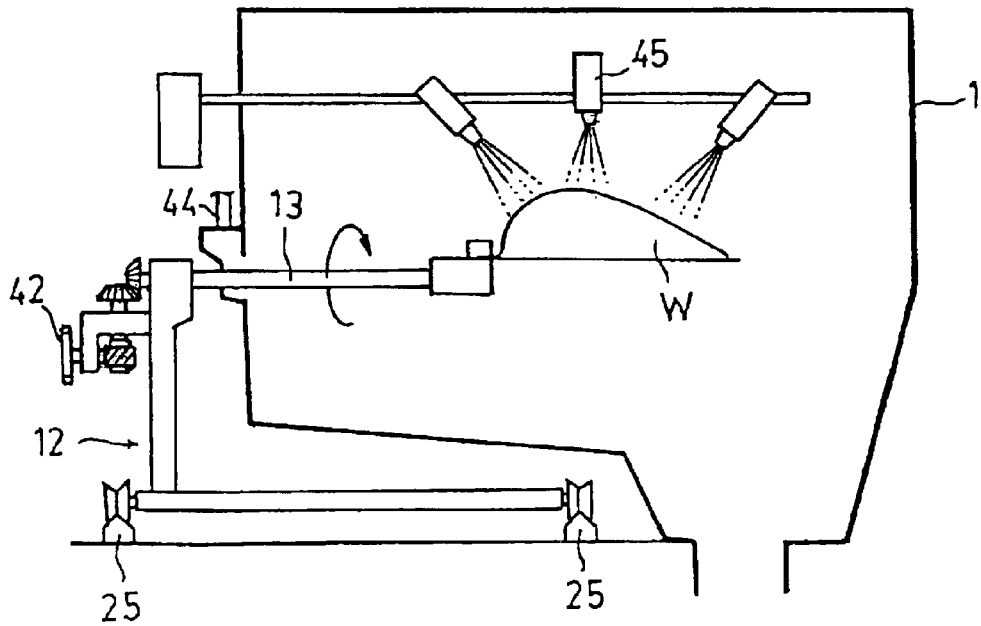
FIG. 2 is a side view showing an outline within a spray booth.

This painting equipment is also provided with a rotational mechanism 28 described later. As shown in FIG. 2, a supporting arm 13 of the conveyance frame 12 is rotated by the rotational mechanism 28 around an arm axis within each of the functional processing station booths 1 through 6 so that painting, drying and the like of the workpiece W supported at an end of the supporting arm 13 can be uniformly performed.

A specific construction of the painting equipment will now be described with reference to FIGS. 3 to 9.

Figure 3:
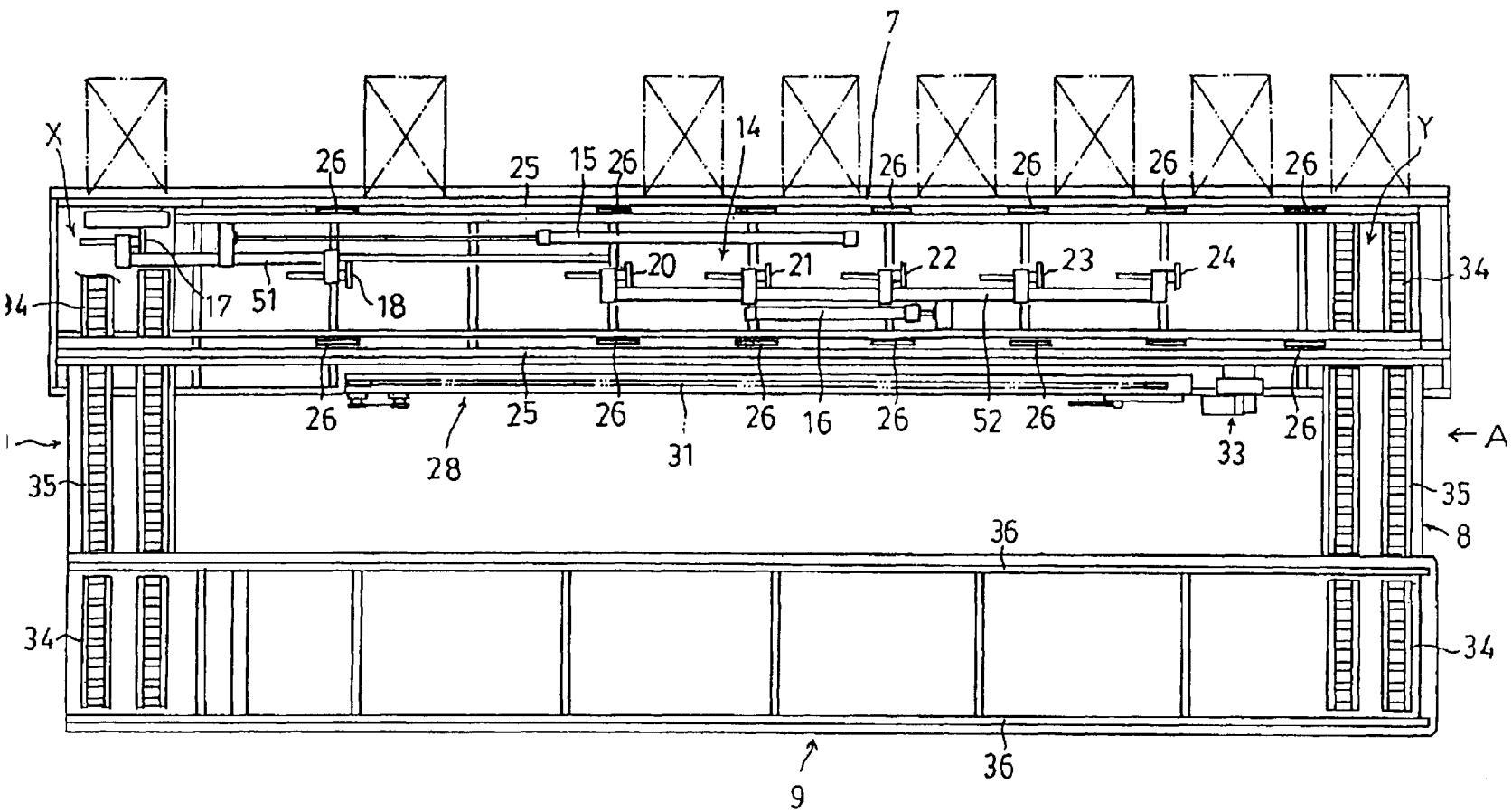
FIG. 3 is a plan view showing a specific construction of the painting equipment.

The shuttle feed passage 7 is provided with a shuttle feed mechanism 14 as shown in FIG. 3.

This shuttle feed mechanism 14 is provided with two kinds of air cylinder units 15, 16 with different feed strokes. A cylinder rod of one air cylinder unit 15 is connected through a connecting rod 51 to a first pusher 17 for feeding the conveyance frame 12 of the supply section X to the spray booth 1 and a second pusher 18 for feeding the conveyance frame 12 within the spray booth 1 to the setting booth 2.

A cylinder rod of the other air cylinder unit 16 is connected, through a connecting rod 52, to a third pusher 20 for feeding the conveyance frame 12 within the setting booth 2 to the preheating booth 3, a fourth pusher 21 for feeding the conveyance frame 12 within the preheating booth 3 to the UV baking booth 4, a fifth pusher 22 for feeding the conveyance frame 12 within the UV baking booth 4 to the after-heating booth 5, a sixth pusher 23 for feeding the conveyance frame 12 within the after-heating booth 5 to the after-heating booth 6 on the downstream side, and a seventh pusher 24 for feeding the conveyance frame 12 within the after-heating booth 6 to the removal section Y, respectively.

Each of the pushers 17–24 is arranged to be able to push the conveyance frame 12 when each pusher takes one stroke forward from the upstream side to the downstream side by the action of the air cylinder units 15, 16. When each pusher goes back to its original position, it can pass without interfering with the conveyance frame 12 on the upstream side, for example, by falling down to one side of each pusher.

The shuttle feed passage 7 is also provided with a pair of guide rails 25 for guiding wheels of the conveyance frame 12. A pair of anti-reverse devices 26 for controlling a retreating position of the conveyance frame 12 is respectively provided, one device on each side of the shuttle feed passage 7 near the guide rails 25 in response to each position of the functional processing stations 1 to 6.

Figure 4:
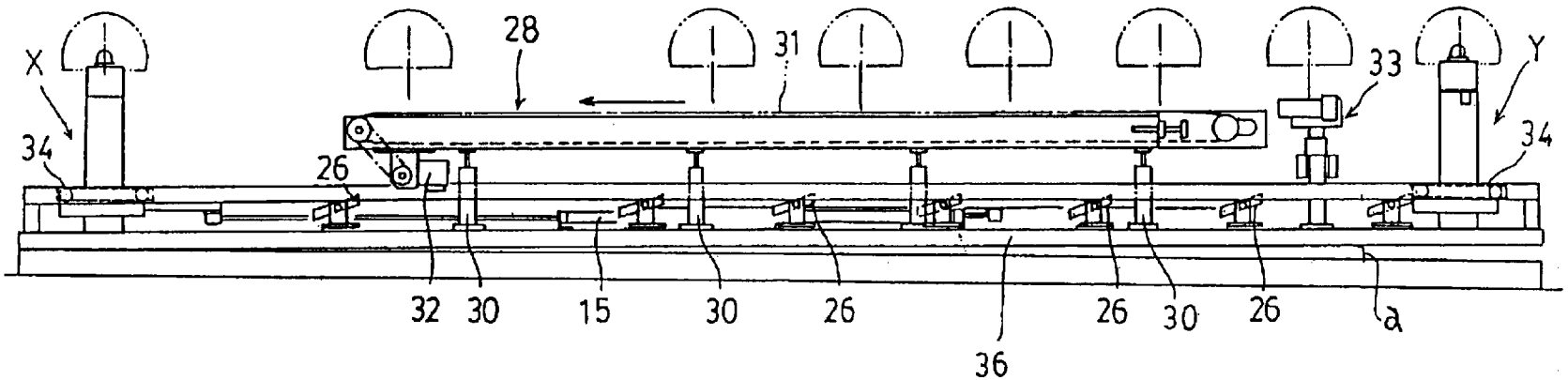
FIG. 4 is a front view of the equipment construction.

This anti-reverse device 26 is designed to allow the conveyance frame 12 to pass when the conveyance frame 12 moves toward the downstream side and not to allow the conveyance frame 12 to pass when the conveyance frame 12 moves toward the upstream side. For example, as shown in FIG. 4, one side of the rockable anti-reverse device 26 is caused to hang down by its own weight.

One of the guide rails 25 is provided with the rotational mechanism 28 on the outside thereof.

The rotational mechanism 28 is provided to rotate the supporting arm 13 of the conveyance frame 12 described later around the axis. As shown in FIGS. 3 and 4, the rotational mechanism is provided with a caterpillar-shaped chain 31 which is provided on the side of one of the guide rails 25 at a fixed height by a plurality of support pillars 30, and a motor 32 for driving the chain 31. A traveling passage of the chain 31 is formed in the direction parallel to the guide rails 25, and the upper side of the chain 31 is arranged to travel from the downstream side of the shuttle feed passage 7 to the upstream side thereof.

A sprocket 42 (described later) of the conveyance frame 12 is engageably provided on the upper side of the chain 31. When the conveyance frame 12 is fed into the spray booth 1, the sprocket 42 engages the chain 31 automatically and the supporting arm 13 starts to rotate around the axis. Once the conveyance frame 12 is fed out of the after-heating booth 6, the sprocket is disengaged from the chain 31.

A rotational positioning mechanism 33 is provided on the downstream side of the rotational mechanism 28.

This rotational positioning mechanism 33 is provided to control the rotational position of the supporting arm 13 at a fixed location. The direction of the supporting arm 13 of the passing conveyance frame 12 is controlled at a fixed location by, for example, a cam mechanism or the like so that the workpiece W can turn upward for easy removal from the supporting arm 13.

Figure 5:
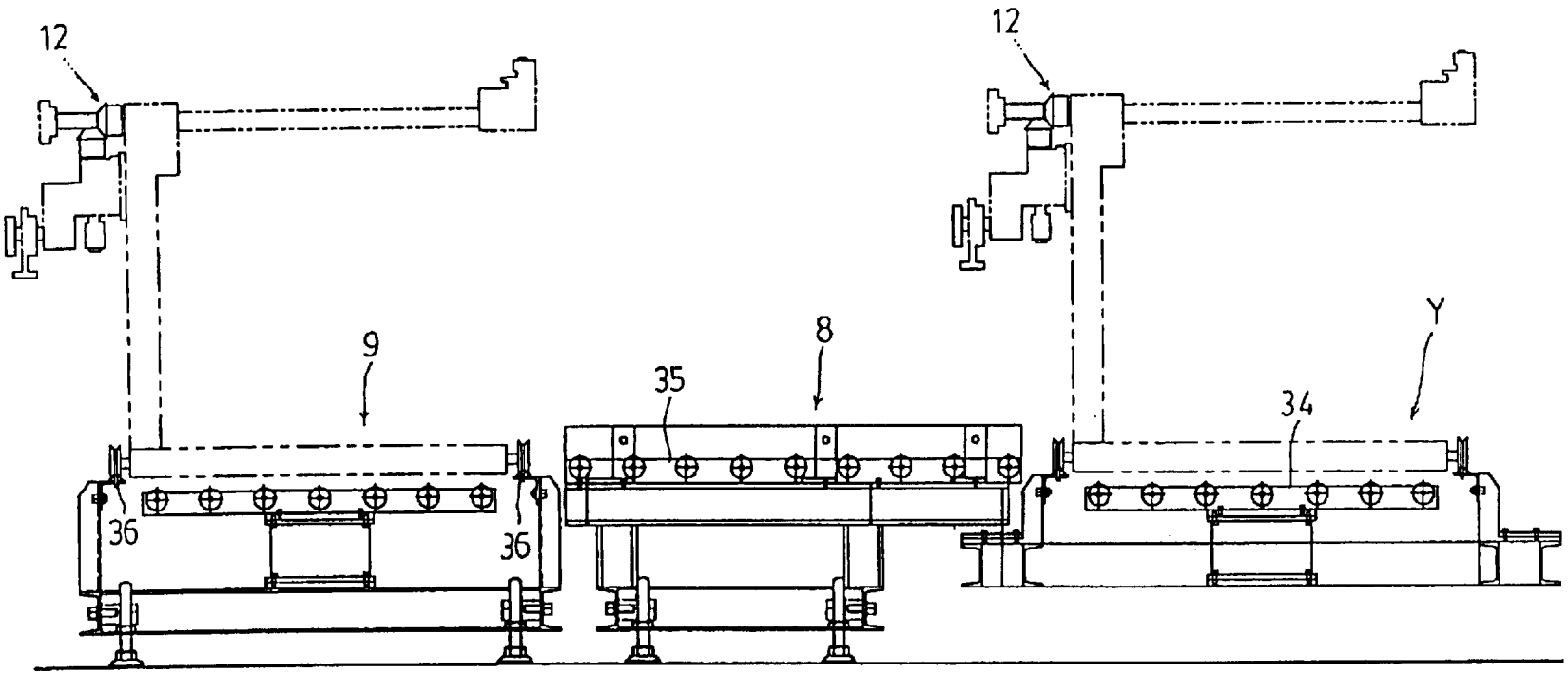
FIG. 5 is a view taken in the direction of the arrow A in FIG. 3.

The construction from the removal section Y through the manual feed passage 8 to the self-propelled feed passage 9 is shown in FIG. 5. Namely, the removal section Y and the self-propelled feed passage 9 are respectively provided with elevation rollers 34. In the removal section Y, the elevation rollers 34 rise up to be able to elevate the conveyance frame 12 fed into the removal section Y by the shuttle feed mechanism 14 to the same height as transfer rollers 35 of the manual feed passage 8. The elevation rollers 34 of the self-propelled feed passage 9 can lower the conveyance frame 12 fed at the same height as the transfer rollers 35 to allow the wheels of the conveyance frame 12 to be mounted on self-propelled rails 36 of the self-propelled feed passage 9.

The self-propelled feed passage 9 is provided with the self-propelled rails 36 from the downstream side toward the upstream side, but the self-propelled rails 36 are provided with a slope α as shown in FIG. 4. Once the conveyance frame 12 is mounted on the self-propelled rails 36 on the downstream side, it travels toward the upstream side by its own weight.

The self-propelled feed passage 9 on the upstream side and the supply section X are also provided with the elevation rollers 34. The manual feed passage 10 between the self-propelled feed passage 9 and the supply section X is provided with the transfer rollers 35 of which the construction is substantially the same as those on the downstream side.

Figure 6:
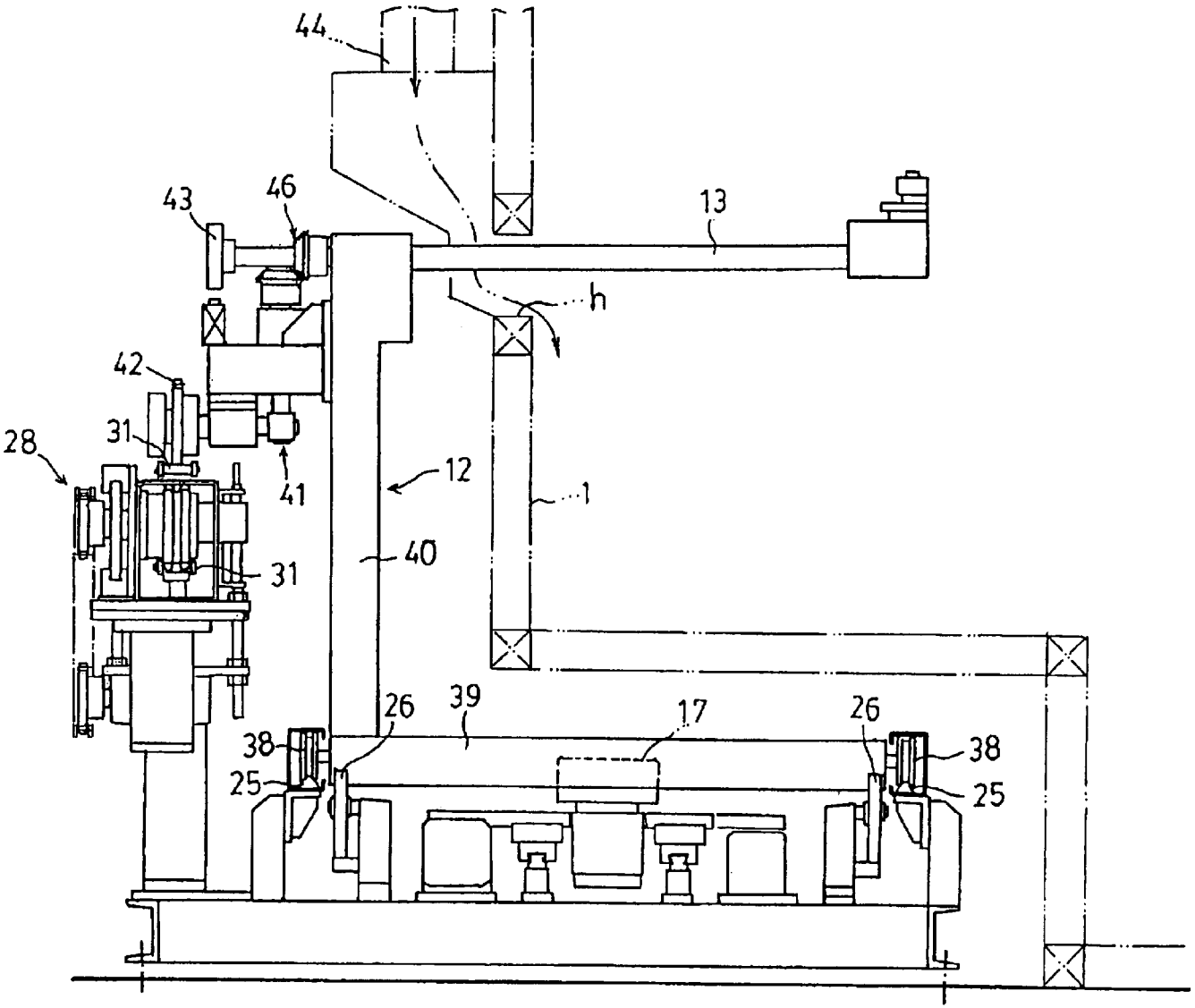
FIG. 6 is a side view of the spray booth and a conveyance frame.
Figure 7:
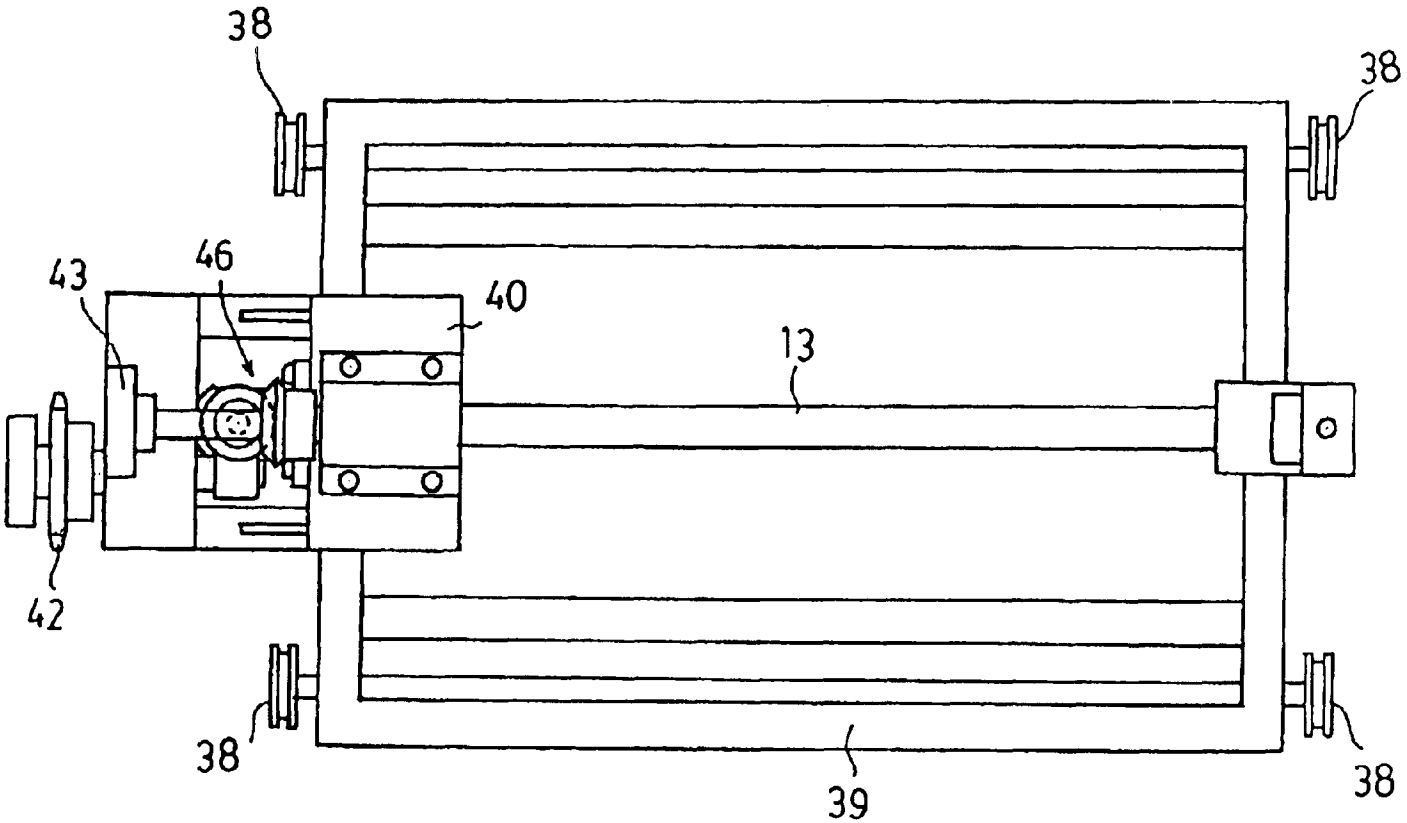
FIG. 7 is a plan view of the conveyance frame.
Figure 8:
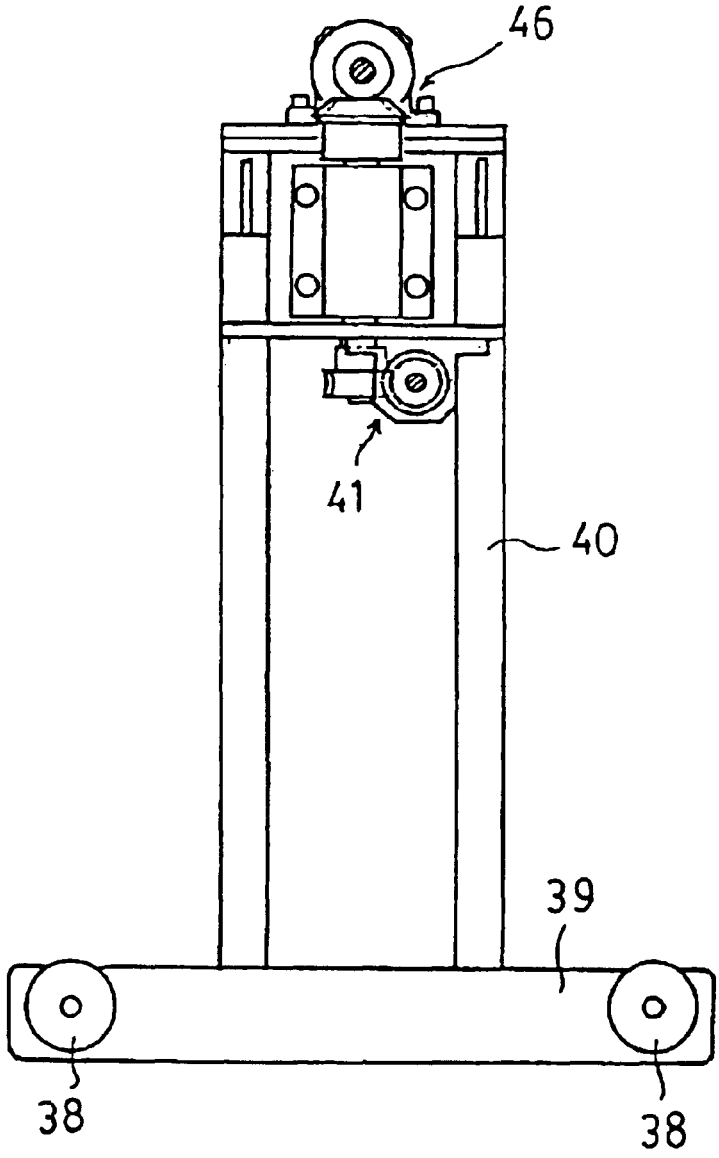
FIG. 8 is a rear view showing a partial cross-section of the conveyance frame.
Figure 9:
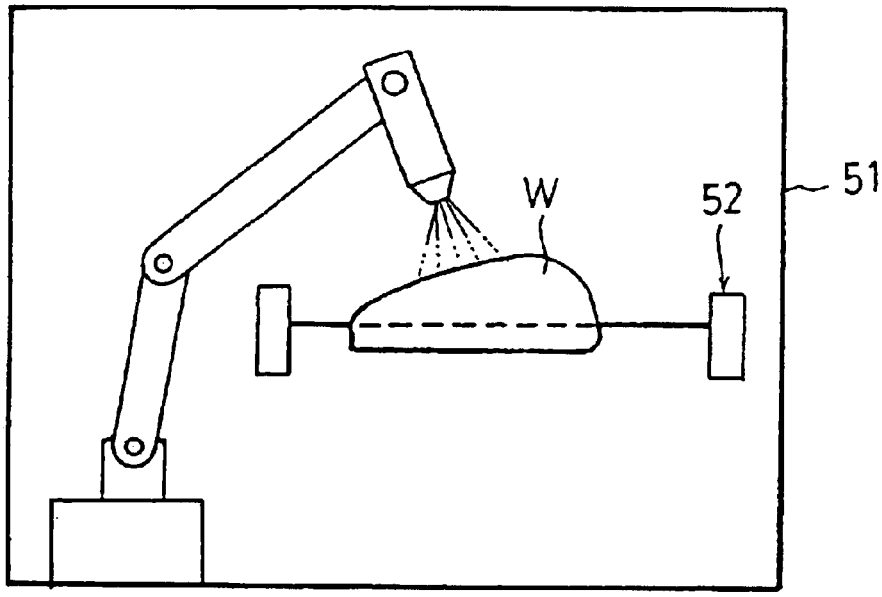
FIG. 9 is a comparative view of conventional painting equipment.

The conveyance frame 12 is provided, as shown in FIGS. 6 through 8, with a carriage 39 with the wheels 38, a pedestal 40 which is vertically provided on one end of the carriage 39, and the supporting arm 13 which is rotatably secured to the upper end section of the pedestal 40. The tip of the supporting arm 13 serves as a holding section for the workpiece W and the base side thereof is connected through a bevel gear 46, worm gear 41, etc. to the sprocket 42.

This sprocket 42 is engageably mounted on the chain 31 of the rotational mechanism 28, wherein the rotation of the sprocket 42 is transmitted through the bevel gear 46, the worm gear 41, etc. (see FIG. 8) to the supporting arm 13.

A gear ratio of this worm gear 41 is set at a large speed reduction ratio of about 20:1 so that the rotational position of the supporting arm 13 once set does not change easily.

Provided on the base side of the supporting arm 13 is a positioning cam 43 for fixing the direction of the supporting arm 13 using the rotational positioning mechanism 33.

As is obvious from FIG. 6, the carriage 39 and the pedestal 40 of the conveyance frame 12 are designed to travel outside each of the booths 1–6, while the supporting arm 13 passes through the booths 1–6. The spray booth 1 is provided, as shown in FIG. 6, with an air blowout section 44 to make airtight an opening section h of the booth 1 into which the supporting arm 13 is inserted, thereby preventing foreign bodies from entering the spray booth 1.

Operation of the painting equipment above will now be described.

In the supply section X, if an operator P installs the workpiece W in the tip of the supporting arm 13 of the conveyance frame 12, preparation for feeding the conveyance frame 12 into the spray booth 1 is completed.

In this case, the first pusher 17 has gone back to a position where it can push the conveyance frame 12 toward the spray booth 1.

When the preparation for transfer is completed, the air cylinders 15, 16 are synchronized, wherein the conveyance frame 12 which is situated in each booth is shuttle-fed to the respective downstream booth in such a manner that the conveyance frame 12 in the supply section X is fed to the spray booth 1, the conveyance frame 12 in the spray booth 1 is fed to the setting booth 2, the conveyance frame 12 in the setting booth 2 is fed to the preheating booth 3 and so on. The sprocket 42 of the conveyance frame 12 fed into the spray booth 1 engages the chain 31 on the upper side of the rotational mechanism 28 and the supporting arm 13 starts rotation around its axis.

Since the traveling direction of the upper chain 31 in the case where the sprocket 42 is engaged is the direction from the downstream side to the upstream side, the chain 31 engages with certainty the sprocket 42 which is moving toward the downstream side. After the engagement is made, a force to push the conveyance frame 12 back toward the upstream side is effected and correct positioning of the conveyance frame 12 can be effected by the anti-reverse devices 26.

In the spray booth 1, as shown in FIG. 2, spray coating is performed by a spray device 45 etc. Since there is no traveling driving section such as the chain within the booth 1, there is no inconvenience whereby the paint adhering to the driving section will peel off and adhere to the coating surface. The opening section h for inserting the supporting arm 13 into the booth 1 is kept airtight by the air blowing out from the air blowout section 44 and foreign bodies are not allowed to enter the booth 1. Accordingly, no inconvenience such as inferior painting is caused.

After conveyance of the workpiece W is stopped, the painting operation is performed, rotating the supporting arm 13 around its axis. Accordingly, by preventing the paint from dripping, it is possible to make the paint film uniform and thus the painting quality can be improved.

After the painting is completed in the coating booth 1, the conveyance frame 12 is fed to the setting booth 2 by the shuttle feeding method, wherein the solvent and the like are blown off. The conveyance frame 12 is then fed to the preheating booth 3, the UV baking booth 4, the after-heating booths 5, 6 in sequence for baking and drying. After baking and drying are completed, the conveyance frame 12 is fed through the rotational positioning mechanism 33 to the removal section Y in a condition in which the direction of the supporting arm 13 is controlled at a fixed position.

The workpiece W is then removed in the removal section Y. Since the workpiece W is positioned in such a- direction that it can be easily removed by the directional control of the supporting arm 13, the workpiece W can be easily removed.

Then, the elevation rollers 34 are elevated to the same height as the transfer rollers 35. After the operator manually transfers the conveyance frame 12 to the elevation rollers 34 on the self-propelled rails 36 side, the elevation rollers 34 are lowered to allow the conveyance frame 12 to be positioned on the self-propelled rails 34.

The conveyance frame 12 now travels on the self-propelled rails 36 toward the upstream side by itself and is returned through the transfer rollers 35 on the upstream side to the supply section X. However, since the supporting arm 13 is continuously maintained in a fixed direction, it is possible to make the setting operation easier when the next workpiece W is set.

With such a configuration as described above, it is possible to improve the painting quality and make the equipment compact and inexpensive.

It is to be noted that the present invention is not limited to the above embodiments, but embodiments having substantially the same construction and the same action and effect as described in the claims of the present invention belong to the technical scope of the present invention.

For example, the kind of the workpiece W is optional.

As described above, according to the present invention, the painting equipment in which the workpiece is fed into the functional processing station, in order, by the conveyance device is provided, in which the conveyance frame is conveyed from the functional processing station on the upstream side to the functional processing station on the downstream side using the shuttle feeding method, and the conveyance frame is caused to cyclically travel by the self-propelled mechanism. Accordingly, it is possible to perform the painting and drying operation, stopping the movement of the workpiece, and to perform high quality painting. It is also possible to make the entire equipment construction compact and inexpensive.

By allowing the carriage for the conveyance frame to travel outside the booth and allowing only the workpiece supporting arm to travel within the booth, it is possible to prevent such inconvenience whereby the paint adheres to the conveyance driving section and some paint peeling off from that section causes the inferior painting. Further, since spray coating is performed, rotating the workpiece, it is possible to improve the painting quality further.

Since the self-propelled passage (i.e. the returning passage) is provided with a downward slope toward the workpiece supply section side, it is possible to allow the conveyance frame to return to the workpiece supply section side by its own weight.

If the rotational positioning mechanism for controlling the rotational position of the workpiece supporting arm at a fixed location on the downstream side of the functional processing station is provided, it is possible to make the removal of the workpiece after painting or the installation thereof before painting easier.

The mechanism for rotating the workpiece supporting arm around the axis is composed of the chain which is provided along the shuttle feed passage, and the sprocket which engages the section of the chain travelling in the direction opposite to the direction of motion of the conveyance frame to transmit the driving force to the axis of the workpiece supporting arm. Accordingly, it is possible to rotate the workpiece supporting arm using a certain and simple mechanism.

What is claimed is:

1. Painting equipment in which a workpiece is fed to functional processing stations, in order, by a conveyance device to perform a series of operations from painting to baking and drying, characterized in that the conveyance device is provided with a shuttle feed mechanism for conveying a conveyance frame for supporting the workpiece from an upstream side of the functional processing stations toward a downstream side of the functional processing stations using a shuttle feed method, and a self-propelled mechanism for allowing the conveyance frame to cyclically travel by itself from the downstream side of the functional processing stations toward the upstream side of the functional processing stations.

2. The painting equipment according to claim 1, wherein the conveyance frame is provided with a carriage which travels outside a booth of each of the functional processing stations, and a workpiece supporting arm which is supported by the carriage and extends within the booths, wherein the workpiece supporting arm is rotatably provided around an arm axis by a rotational mechanism.

3. The painting equipment according to claim 1, comprising a cyclically traveling passage, wherein the cyclically traveling passage is composed of a shuttle feed passage, a self-propelled feed passage, and a manual feed passage for connecting the shuttle feed passage and the self-propelled feed passage, wherein the shuttle feed passage is provided with a cylinder unit for feeding the conveyance frame from the upstream side to the downstream side in order, and the self-propelled feed passage is provided with a slope to allow the conveyance frame to return to a workpiece supply section side by its own weight.

4. The painting equipment according to claim 2, wherein a rotational positioning mechanism is provided on the downstream side of the functional processing stations to control the rotational position of the workpiece supporting arm at a fixed location.

5. The painting equipment according to claim 2, wherein the mechanism for rotating the workpiece supporting arm around the axis is provided with a chain which is provided along the shuttle feed passage, and a sprocket which engages a section of the chain traveling in a direction opposite to a direction of travel of the conveyance frame to transmit a driving force to the axis of the workpiece supporting arm.

6. The painting equipment according to claim 3, wherein a rotational positioning mechanism is provided on the downstream side of the functional processing stations to control the rotational position of the workpiece supporting arm at a fixed location.

7. The painting equipment according to claim 3, wherein the mechanism for rotating the workpiece supporting arm around the axis is provided with a chain which is provided along the shuttle feed passage, and a sprocket which engages a section of the chain traveling in a direction opposite to a direction of travel of the conveyance frame to transmit a driving force to the axis of the workpiece supporting arm.

* * * * *